US006000197A

United States Patent [19]

Ausnit

[11] Patent Number: 6,000,197

[45] Date of Patent: Dec. 14, 1999

[54] PROCESS AND MACHINE FOR FORMING BAGS HAVING A FASTENER ASSEMBLY WITH TRANSVERSE PROFILES

[75] Inventor: Steven Ausnit, New York, N.Y.

[73] Assignee: Illinois Tool Works Inc., Glenview, Ill.

[21] Appl. No.: 09/177,212

[22] Filed: Oct. 22, 1998

[30] Foreign Application Priority Data

Mar. 10, 1998 [FR] France ..... 98 02287

[51] Int. Cl.[6] ..... B65B 61/18

[52] U.S. Cl. ..... 53/412; 53/133.4; 53/139.2; 493/213; 493/214; 493/927

[58] Field of Search ..... 53/410, 412, 451, 53/551, 133.4, 139.2; 493/213, 214, 927

[56] References Cited

U.S. PATENT DOCUMENTS

| | | | |
|---|---|---|---|
| 4,617,683 | 10/1986 | Christoff | 53/139.2 X |
| 4,655,862 | 4/1987 | Christoff et al. | 493/927 X |
| 4,709,398 | 11/1987 | Ausnit | 53/139.2 X |
| 4,844,759 | 7/1989 | Boeckmann | 493/927 X |
| 4,878,987 | 11/1989 | Ven Erden | 493/213 X |
| 4,909,017 | 3/1990 | McMahon et al. | 53/133.4 X |
| 5,111,643 | 5/1992 | Hobock . | |
| 5,557,907 | 9/1996 | Malin et al. | 53/139.2 |
| 5,564,259 | 10/1996 | Stolmeier . | |
| 5,592,802 | 1/1997 | Malin et al. | 53/133.4 |
| 5,776,045 | 7/1998 | Bodolay et al. | 493/927 X |
| 5,816,018 | 10/1998 | Bois | 53/133.4 |

FOREIGN PATENT DOCUMENTS 0 728 665 A1 8/1996 European Pat. Off. .

*Primary Examiner*—Daniel B. Moon
*Attorney, Agent, or Firm*—Kane, Dalsimer, Sullivan and Levy, LLP

[57] ABSTRACT

A process for manufacturing bags on an automatic forming, filling and sealing (FFS) machine (100) wherein a tube (20) capable of forming walls (38, 40) of a bag is sequentially cut into portions by a cut which is approximately transverse with respect to the direction of movement of the tube (20). A fastener assembly (50) is attached to the cut end of that part of the tube (20) that is below the filling chute (110) of the FFS machine.

33 Claims, 14 Drawing Sheets

10
12
14
110
124
122
120
100
114
112
132
32
130
142
140
38
144
40
20
160
164
162
170
152
150
182
42
50
154
51
52
184
186
182
180
183
53
55

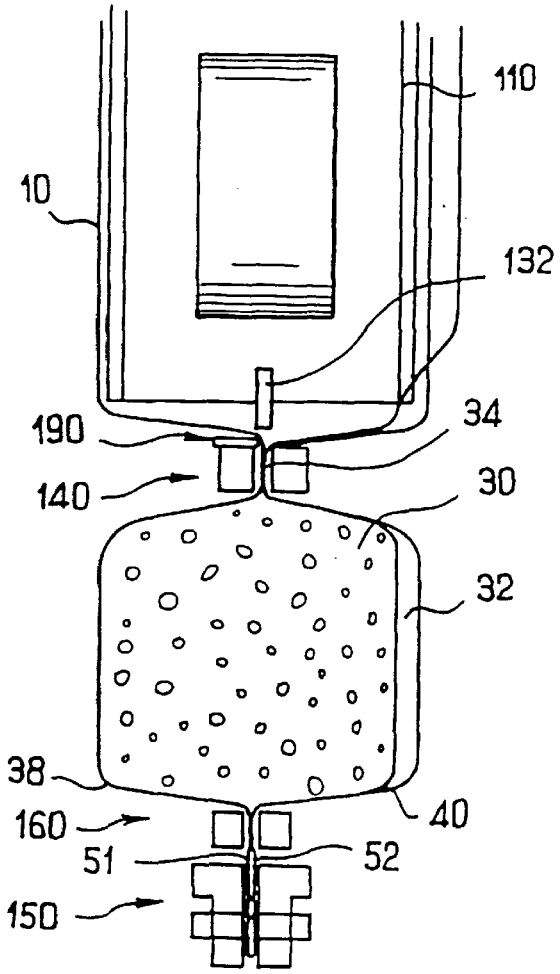
FIG_12
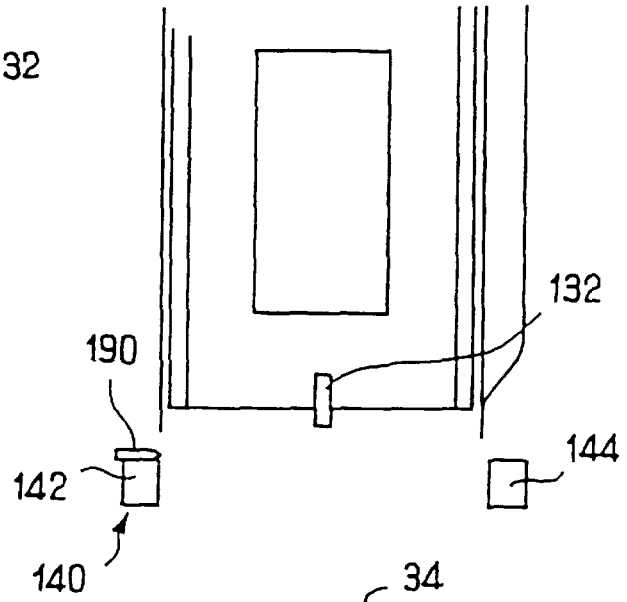
FIG_13
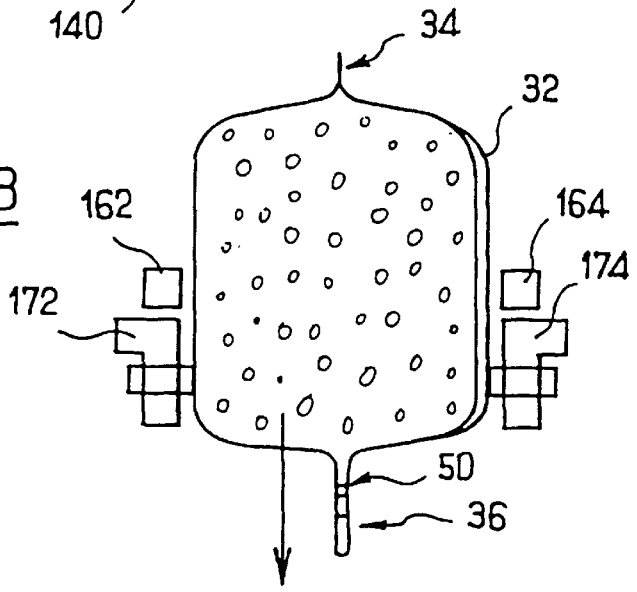

PROCESS AND MACHINE FOR FORMING BAGS HAVING A FASTENER ASSEMBLY WITH TRANSVERSE PROFILES

BACKGROUND OF THE INVENTION

The present invention relates to the field of bags or bags comprising complementary interlocking profiles designed to allow successive opening and closing operations by the user. More specifically, the present invention relates to the field of machines designed for automatically forming, filling and sealing packaging formed of plastic films, especially thermoplastic films, provided with such complementary interlocking profiles. Such machines are commonly called FFS (Form, Fill and Seal) machines.

DESCRIPTION OF THE PRIOR ART

FFS machines of this type have already been proposed (see, for example, documents EP 528,721 and U.S. Pat. No. 4,894,975).

Most of these machines comprise a forming collar which receives, as input, the flat film coming from a pay-out stand and which delivers, as output, the film shaped as a tube, a filling chute which runs into the forming collar and consequently into the tube, means for conveying fastener assemblies and for attaching them to the film, longitudinal welding means for sealing the tube longitudinally and means capable of sequentially generating a first transverse weld before a product is introduced into the tube via the filling chute, as well as a second transverse weld after the product has been introduced into the tube, in order to seal the package.

Some of these machines are designed to receive sealing strips in a longitudinal direction, i.e. parallel to the direction of movement of the film. Other machines are designed to place the sealing strips transversely, i.e. perpendicular to the direction of movement of the film (see, for example, U.S. Pat. No. 4,617,683, U.S. Pat. No. 4,655,862, U.S. Pat. No. 4,909,017, U.S. 5,111,643 and EP 728,665).

U.S. Pat. No. 4,617,683, U.S. Pat. No. 4,655,862 and U.S. Pat. No. 4,909,017 propose solutions for conveying the transverse profiles onto while the film is still in a flat state, i.e. upstream of the forming collar. U.S. Pat. No. 5,111,643 relates to a machine in which a continuous support strip conveys the fastener assemblies, via the inside of the filling chute, downstream of the collar. U.S. Pat. No. 5,557,907 and EP 728,655 describe a process for conveying, downstream of the chute, a fastener assembly transversely with respect to the movement of the film and for attaching it to the film after it is formed into a tube. This process consists of:

- feeding a film onto a filling chute of an FFS machine in order to form a tube by bringing one of the two longitudinal edges of the film onto the other;
- welding the longitudinal edges of the film, leaving an unwelded region a few centimeters in width;
- moving the longitudinal edges in the unwelded region apart;
- inserting a fastener assembly mounted on a guide into the tube, via the unwelded region;
- welding the fastener assembly to the inner face of the walls of the tube;
- removing the guide from the fastener assembly; and
- welding the longitudinal edges of the film in the unwelded region.

This method is quite complex and has certain drawbacks. In particular, the method does not allow fastener assemblies to be welded to the outer wall of the tube nor does it permit the use of slider operated fasteners. In addition, it would be advantageous, for example, to be able to use fastener assemblies which have webs with a variable width in the direction parallel to the movement of the film, or other characteristics, without having to modify the machine with regard to the separation defining the size of the unwelded region between the welding means.

SUMMARY OF THE INVENTION

The object of the invention is to improve machines for automatically forming, filling and sealing reclosable bags. More specifically, the object of the invention is to provide a process and a machine for automatically forming, filling and sealing bags which make it possible to attach, downstream of the filling chute, fastener assemblies of any shape, characteristic and of any width, with or without sliders, without having to modify the machine, and which makes it possible to attach fastener assemblies to the outer wall of the tube.

This above and other beneficial objects are attained by providing a process for manufacturing bags which comprises the steps of:

- advancing, downstream of a vertical filling chute, a tube capable of forming walls of a bag;
- sequentially cutting the tube into portions by a cut which is approximately transverse with respect to the direction of movement of the tube,
- attaching a fastener assembly to a cut end of the tube that is still held by the chute.

The invention also relates to a machine for implementing this process. Such a machine comprises:

- means for advancing, downstream of a vertical filling chute, a tube capable of forming walls of a bag,
- cutting means for cutting the tube approximately transversely to its direction of movement,
- welding means for welding a fastener assembly to an end of the cut part of the tube which is still held against the chute.

Thus, by virtue of the process and of the machine according to the invention, it is possible to attach fastener assemblies both to the inner face and to the outer face of the walls of the bag. The process and the machine according to the invention make it possible to use fastener assemblies with webs of varying width, U-shaped, tamper-evident webs, webs which can be welded to a sealable weld and webs covered with various coatings. It is also possible to use fastener assemblies with gasket film, with funnel means for pouring the contents of the bag, with webs forming hinges, with slider operated fasteners, etc.

Other aspects, objects and advantages of the invention will appear on reading the detailed description which follows. dr

BRIEF DESCRIPTION OF THE DRAWINGS

In the accompanying drawings:

FIG. 12 is a diagrammatic view, in side elevation, of the FFS machine illustrated in FIG. 11 at a subsequent step in the process;

FIG. 13 is a diagrammatic view, in side elevation, of the FFS machine illustrated in FIG. 12 at a subsequent step in the process;

DESCRIPTION OF THE PREFERRED EMBODIMENTS

A preferred way of implementing the process according to the invention is described in a detailed manner below. An FFS machine for implementing such a process is also described.

Figure 1:
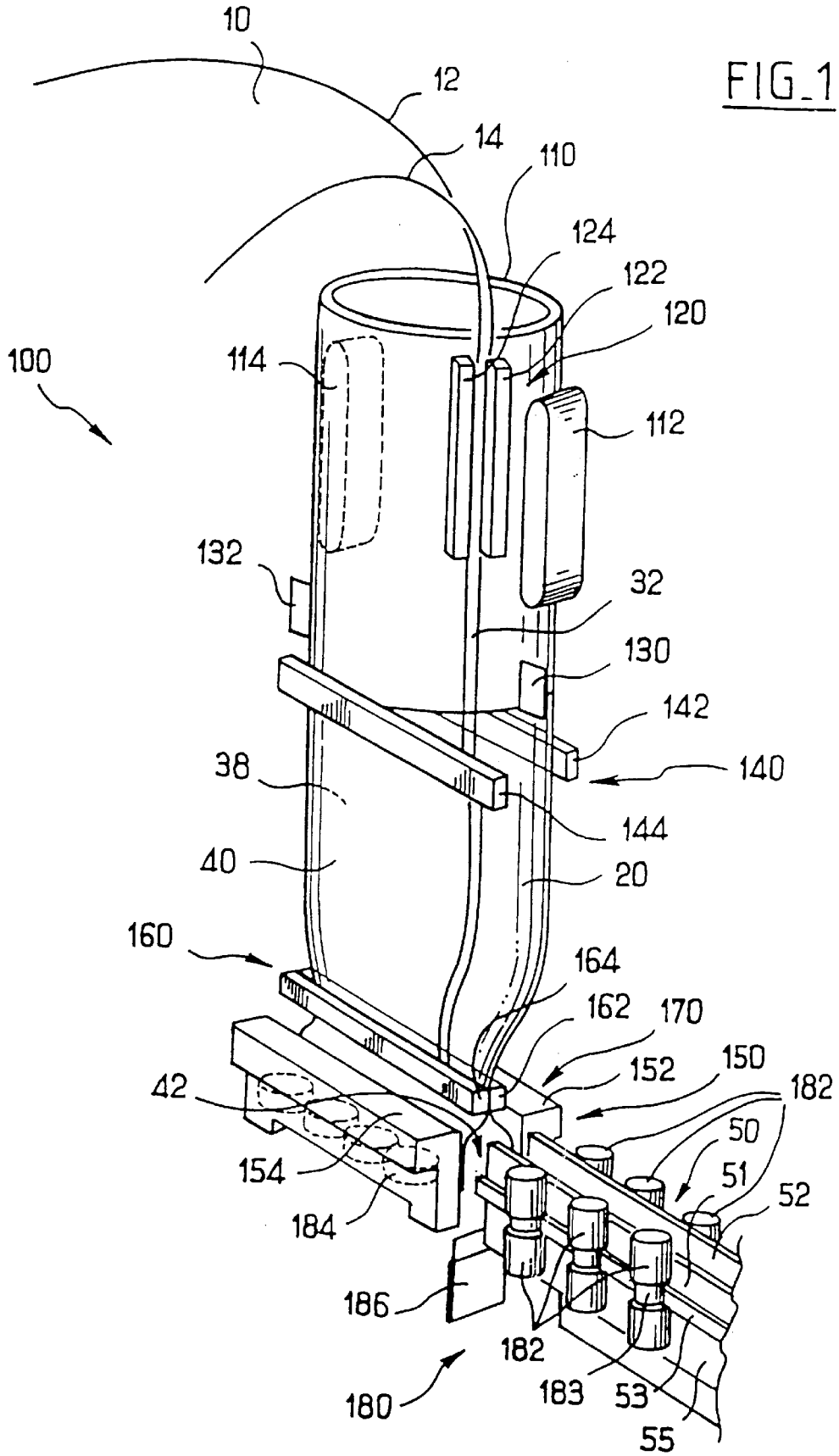
FIG. 1 is a perspective view of an FFS machine according to the invention.

As illustrated in FIG. 1, a film 10 is fed into an FFS machine 100. The FFS machine 100 comprises a filling chute 110, means 112, 114 for driving the film 10, longitudinal welding means 120, blades 130, 132, first welding means 140, second welding means 150, means 160 for clamping the tube 20, guiding means 180, holding means 170 and cutting means 190.

The chute 110 is in the shape of a hollow cylinder and preferably is vertical. The driving means 112, 114 consist, for example, of a belt which presses the film 10 against the outer wall of the chute 110.

The longitudinal welding means 120 consist, for example, of two welding bars 122, 124 which are parallel to the axis of symmetry of revolution of the chute 110.

The two blades 130, 132 are diametrically opposed with respect to the chute 110 disposed near the bottom thereof.

The guiding means 180 are used to guide a fastener assembly 50 in order to attach it to a bag 30.

The first welding means 140, the second welding means 150, the means 160 for clamping the tube 20, the guiding means 180, the holding means 170 and the cutting means 190 will be described in detail later.

The film 10 is wrapped around the filling chute 110 in order to form the tube 20. The film 10 has two longitudinal edges 12, 14 which are parallel to the direction of movement of the film 10. These longitudinal edges 12, 14 are brought together, one adjacent the other, after the film 10 has enveloped the chute 110. Next, the film 10 is driven towards the bottom of the filling chute 110 by the driving means 112, 114.

The longitudinal edges 12, 14 are then welded together by the longitudinal welding means 120. A longitudinal seam weld 32 is thereby obtained and the tube 20 is formed. Next, it is driven towards the bottom of the chute 110.

The tube 20 is then fed into the second welding means 150 where the fastener assembly 50 is attached to that end of the tube lying downstream of the chute 110.

Figure 2:
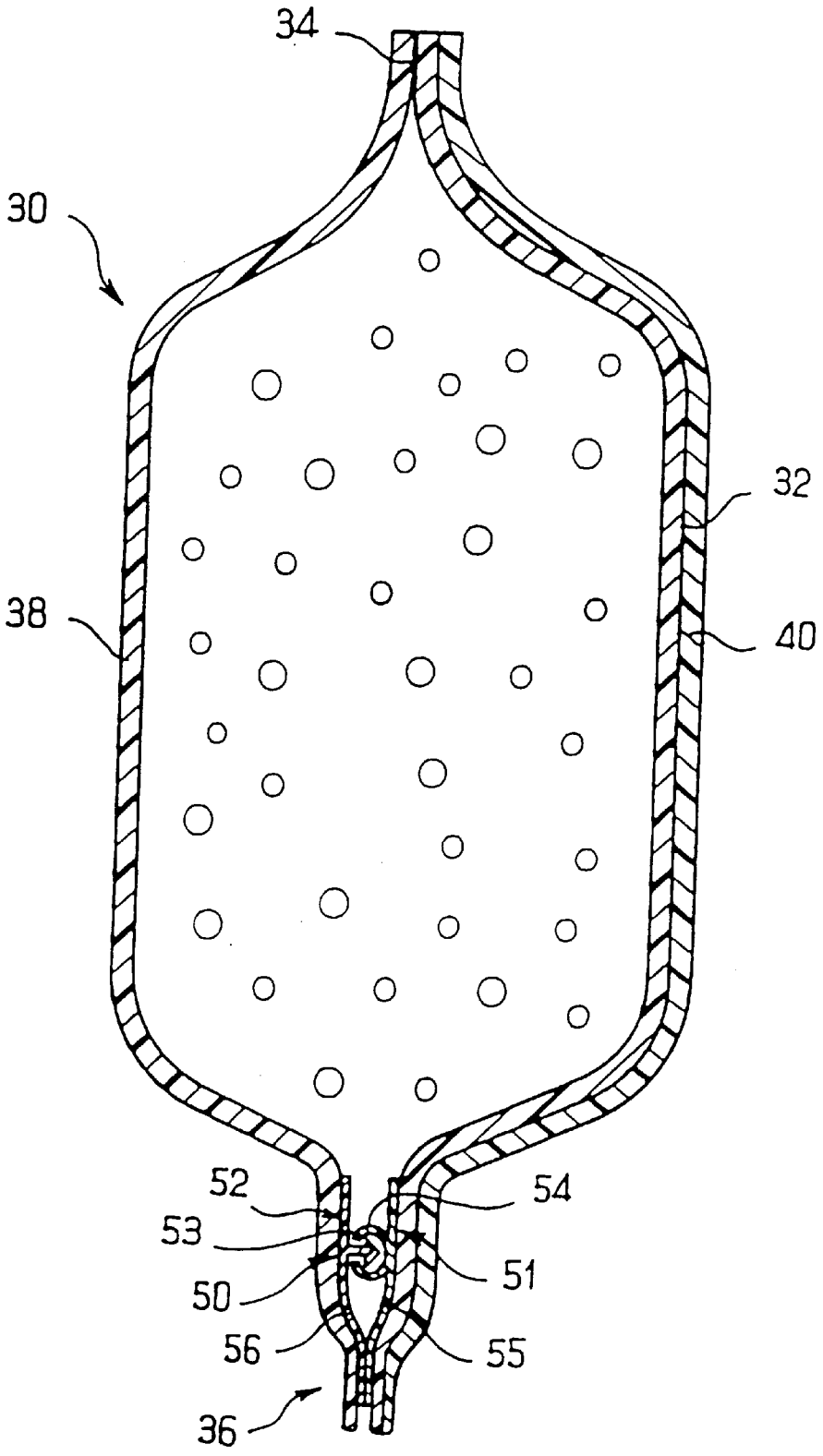
FIG. 2 is a sectional view of a bag formed by the process and on the machine according to the invention.

As illustrated in FIG. 2, the bag 30 formed by the process consists of walls 38, 40 and the fastener assembly 50. The walls 38, 40 are formed by folding together two elements of the film 10 along two longitudinal folds with respect to the direction of movement of the tube 20. The longitudinal edges 12, 14 are welded together by the longitudinal weld 32. A first transverse weld 34 and a second transverse weld 36 are formed perpendicular to the longitudinal weld 32. The first weld 34 is formed near that end of the bag 30 which is closest to the filling chute 110. The second weld 36 is formed near that end of the bag 30 that is furthest from the filling chute 110. The fastener assembly 50 is placed parallel to the second weld 30, near the latter.

The fastener assembly 50 consists of two reclosable strips 51, 52. The strips 51, 52 have a female interlocking profile 53 and a male interlocking profile 54, respectively, which are capable of engagement one in the other. Webs 55, 56 extend laterally on each side of these profiles 53, 54. These fastener assemblies 50 may be of any shape known by those skilled in the art. In particular, each strip 51, 52 may comprise one or more profiles 53, 54.

For example, in the case of the embodiment corresponding to FIG. 2, the webs 55, 56 may be joined together by a peel seal formed on the side of the profiles 53, 54 which lies near the end of the bag 30 furthest from the chute 110.

Figure 3:
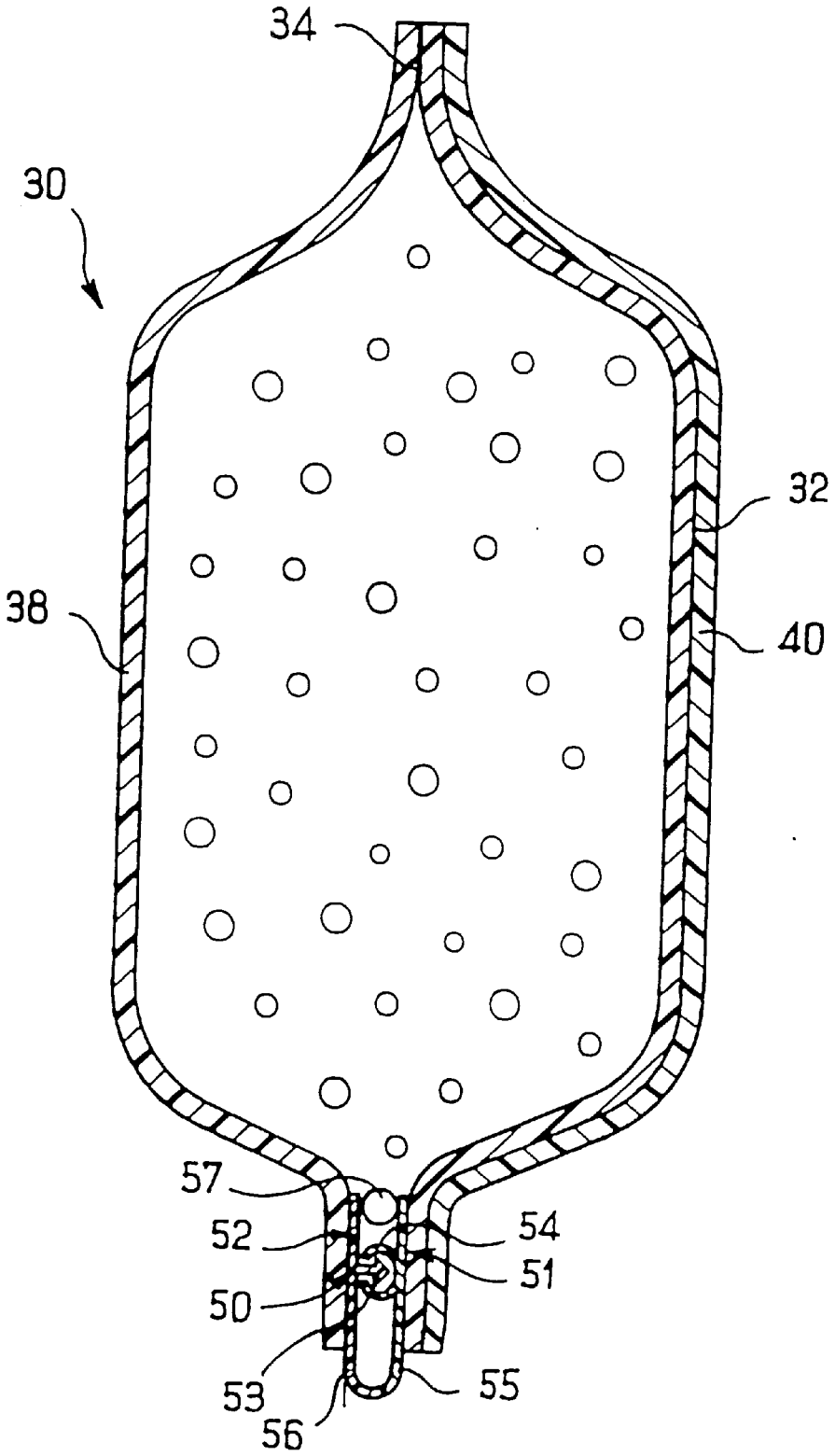
FIG. 3 is a sectional view of a variant of the bag illustrated in FIG. 2.

In another embodiment illustrated in FIG. 3, the fastener assembly 50 comprises webs 55, 56 which are joined together in a continuous manner over their entire length in order to close that end of the bag 30 that is furthest from the chute 110, which then has, in cross section, the shape of a U. A peel seal 57 is formed parallel to the profiles 53, 54, towards the inside of the bag, between the webs 55, 56.

Figure 4:
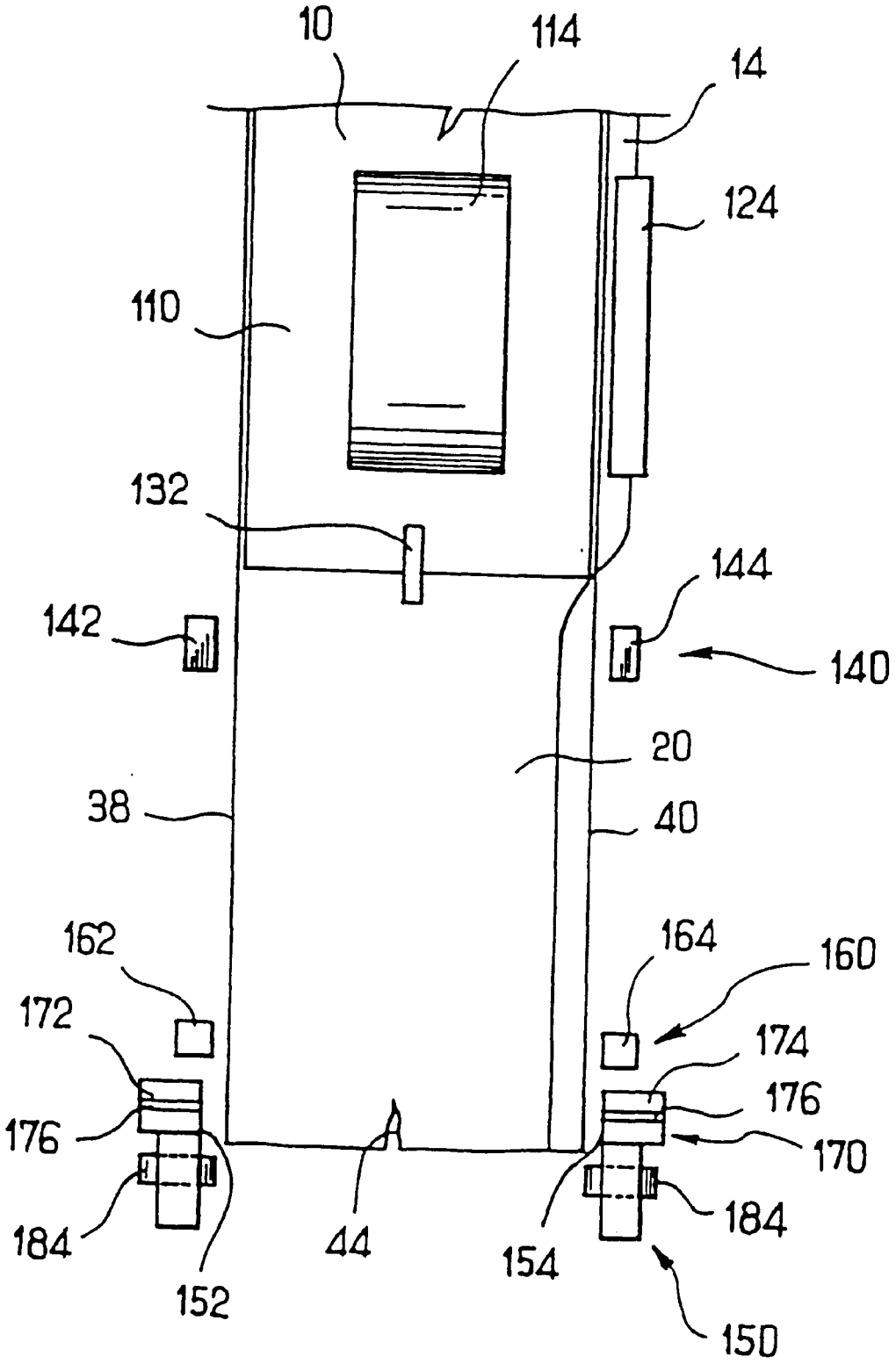
FIG. 4 is a diagrammatic view, in side elevation, of an FFS machine for implementing the process according to the invention.

FIG. 4 illustrates, the first welding means 140 and the second welding means 150, as well as the clamping means 160. The first welding means 140 consists of two welding bars 142,144. The second welding means 150 consists of two welding bars 152, 154. The clamping means 160 consists of two clamping bars 162, 164. The welding bars 142, 144 are capable of moving in a reciprocal motion between two positions in a plane perpendicular to the direction of movement of the tube 20. In one of these positions, they are separated from each other by a distance greater than the diameter of the tube 20 (FIG. 13). In the other position, they are clamped against those parts of the film 10 that are intended to form the walls 38, 40 (FIG. 12). The same applies to the welding bars 152, 154 and to the clamping bars 162, 164.

The contents of a bag 30 may be poured into the chute 110 in order to fill the bag 30 after the clamping means 160 have, where necessary, clamped the walls 38, 40 of the tube 20 against each other.

Figure 5:
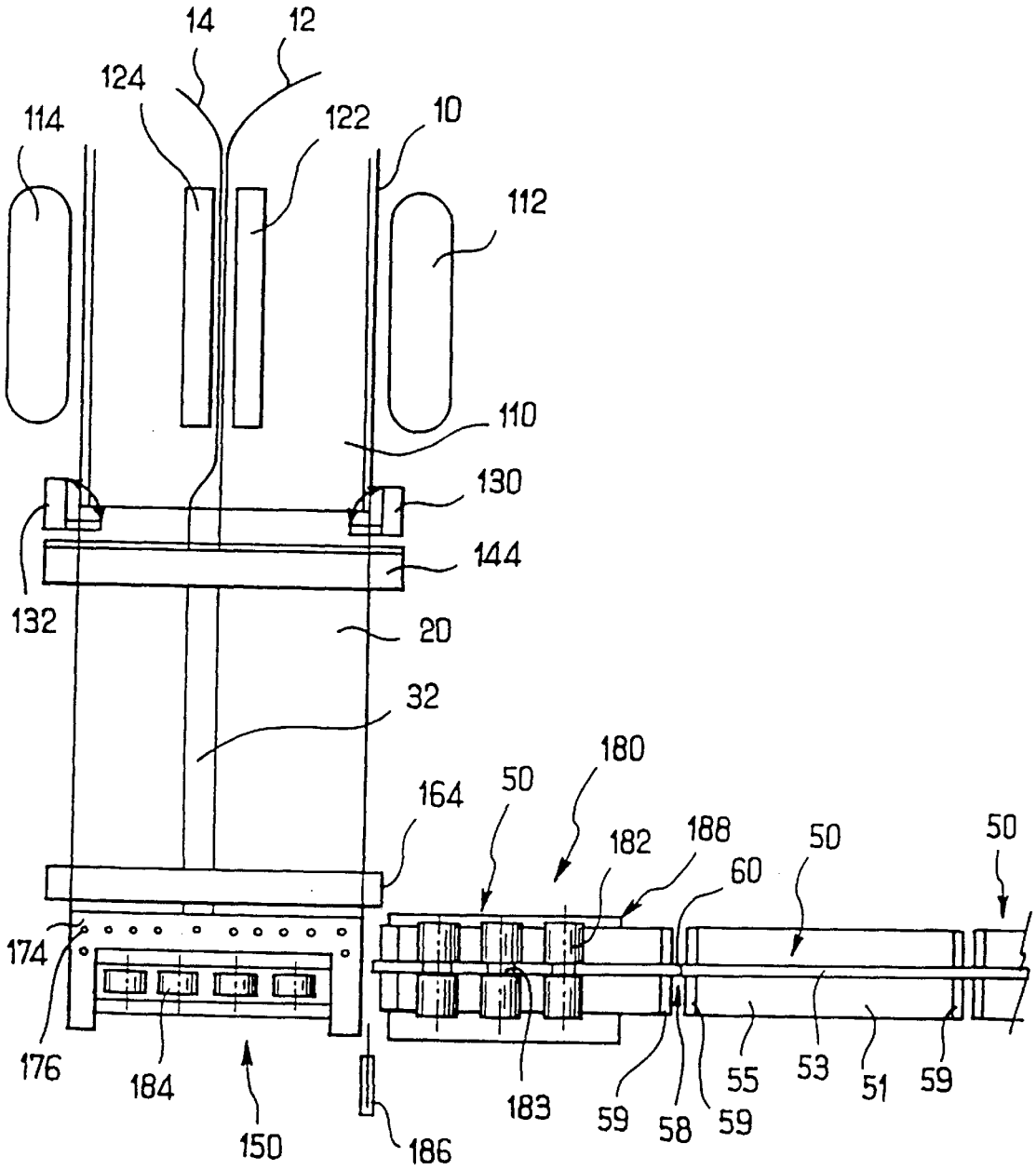
FIG. 5 is a diagrammatic view, in side elevation, of the FFS machine of FIG. 4, turned through 90.

As illustrated in FIG. 5, the guiding means 180 are used to feed a chain of fastener assemblies 50 transversely with respect to the direction of movement of the tube 20. Each portion of the chain corresponds to one fastener assembly 50.

The fastener assemblies 50 are separated from each other by a space 58. The spaces 58 are cut in the fastener assemblies 50, leaving links of material 60 fastening the fastener assemblies 50 to each other. Simultaneously with cutting the spaces 58 and forming the links 60, end weld s 59, at each end of each fastener assembly 50 may be formed. Forming the end welds 59 in such a way makes it easier for the second welding means 150 to weld each end of a fastener assembly 50 to the walls 38, 40.

The guiding means 180 comprise grooved small rollers 182 and a plate 188 for guiding the strips 51, 52 of the fastener assembly 50. The plate 188 is vertical and parallel to the two strips 51, 52. It lies on the other side of the strips 51, 52 with respect to the grooved small rollers 182. The grooved small rollers 182 press the strips 51, 52 against the plate 188. In another embodiment, another series of grooved small rollers 182 replaces the plate 188 so that the strips 51, 52 of the fastener assembly are guided by the two series of small rollers 182 (FIG. 1). The grooved small rollers 182 are in a cylindrical shape with a groove 183 formed around the cylinder, halfway along it. The profiles 53, 54 fit into this groove 183, which thus allows them to be guided.

A knife 186 moves longitudinally with respect to the direction of movement of the tube 20 between the guiding means 180 and the second welding means 150. The knife 186 is used to cut the chain of fastener assembly into sections, by cutting the links of material 60, after a fastener assembly 50 has been positioned in the second welding means 150.

Figure 6:
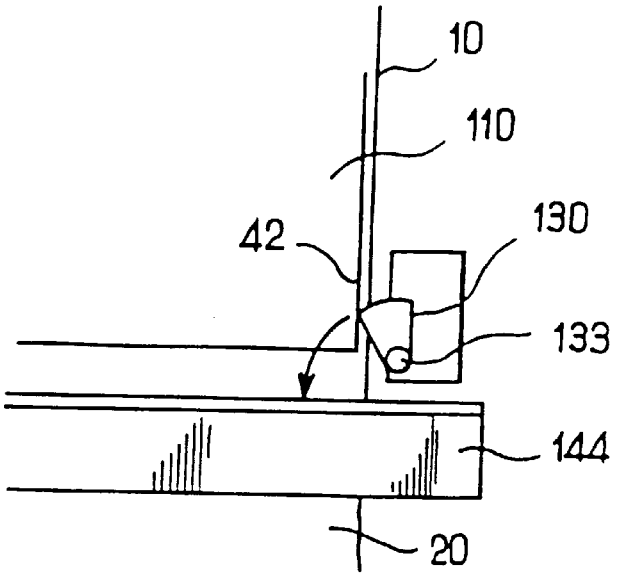
FIG. 6 illustrates diagrammatically, a lateral cutting means of the FFS machine for implementing the process according to the invention.

FIG. 6 illustrates the blade 130 in greater detail. The blade 130 pivots on a pin 133. This pin 133 is perpendicular to the direction of movement of the tube 20 and is parallel to the tangent of the chute 110. The blade 130 pivots between two positions, one in which it is parallel to the longitudinal axis of the chute 110 and the other in which it is perpendicular to the latter. By swinging between these two positions, the blade 130 creates a slit 42 in the film 10. Likewise, the blade 132 creates the slit 44.

Sequentially, the two pivoting blades 130,132 side simultaneously cut the slits 42, 44 in the wall of the tube 20. These slits 42, 44 are diametrically opposite each other with respect to the longitudinal central axis of the chute 110 and at the same height along the tube 20. They facilitate the step of inserting the sealing strips 51, 52 between the held-apart walls 38, 40. The distance between each pair of slits 42, 44 in the longitudinal direction of the tube 20, with respect to its movement, corresponds approximately to the length of a bag in this direction.

The slits 42, 44 may also be created by other appropriate means known by those skilled in the art.

Figure 7:
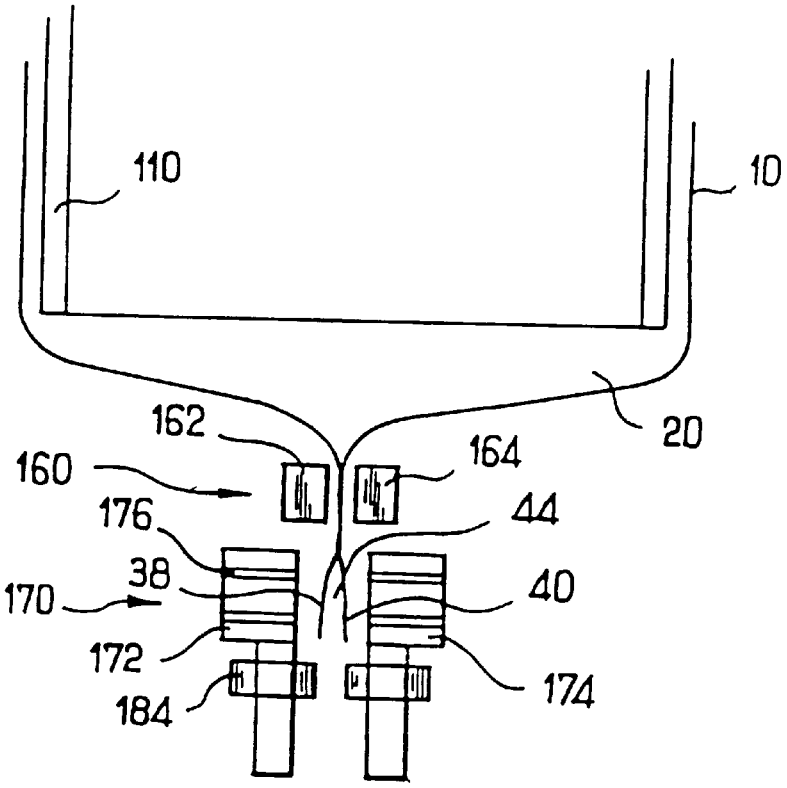
FIG. 7 illustrates diagrammatically, in cross section, holding and welding means of the FFS machine for implementing the process according to the invention.

FIGS. 7 to 13 illustrate diagrammatically the steps of fitting the fastener assembly 50 downstream of the chute 110. The tube 20 is clamped downstream of the chute 110 by the clamping means 160. By flattening the tube 20, the two bag walls 38, 40 are produced. The walls 38, 40, intended to form a bag, are thus pressed against each other over their entire length in the transverse direction with respect to the direction of movement of the tube 20, upstream of the position of the interlocking strips 51, 52. This allows the bag 30 to be filled, down-stream of the pressing position, via the chute 110 simultaneously with the welding steps. Downstream of the clamping means 160, the edges of the walls 38, 40 are formed by an end cut perpendicular to the direction of movement of the tube 20. Near this cut end, the walls 38, 40 are separated from each other by the slits 42, 44 (FIG. 7).

Figure 8:
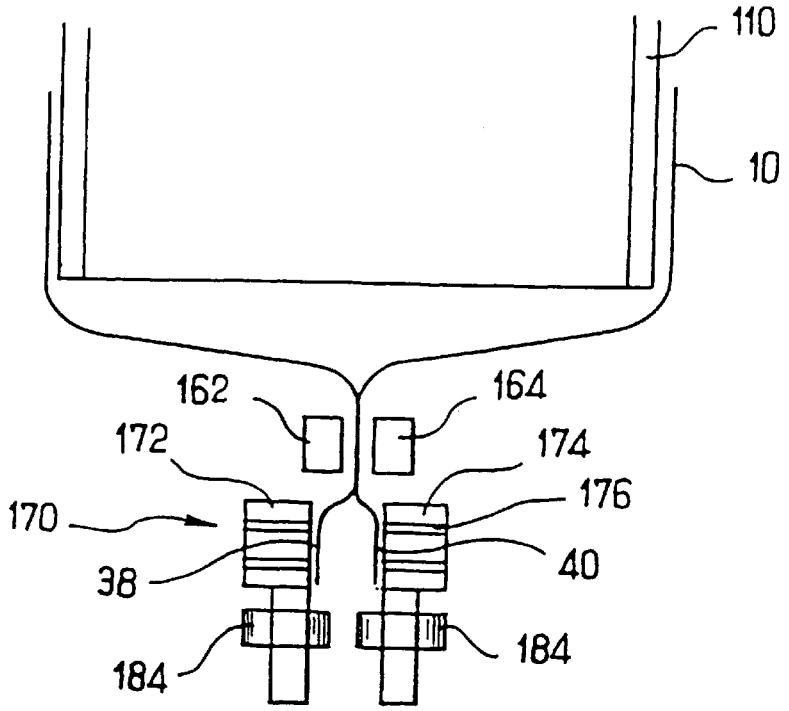
FIG. 8 illustrates diagrammatically, in cross section, the means illustrated in FIG. 7 at a subsequent stage in the process.
Figure 9:
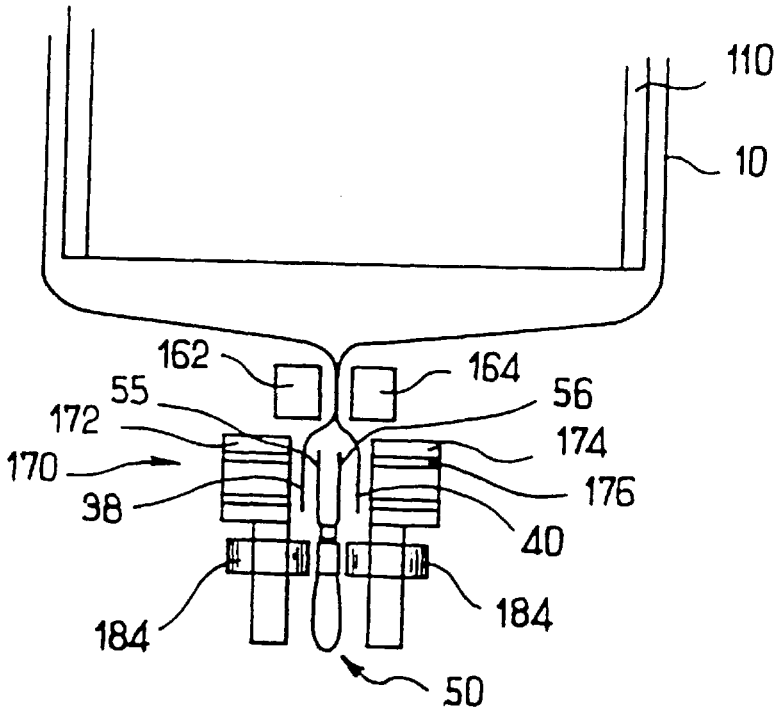
FIG. 9 illustrates diagrammatically, in cross section, the means illustrated in FIGS. 7 and 8 at a subsequent step in the process.

Next, the separated regions of the walls 38, 40 are held and then moved apart by the holding means 170 (FIG. 8). A fastener assembly 50 is then fed and positioned by the guiding means 180 between the separated walls 38, 40. Beneath the holding means 170, small wheels 184 allow the fastener assembly 50 to be driven and guided between the walls 38, 40 (FIG. 9).

Figure 10:
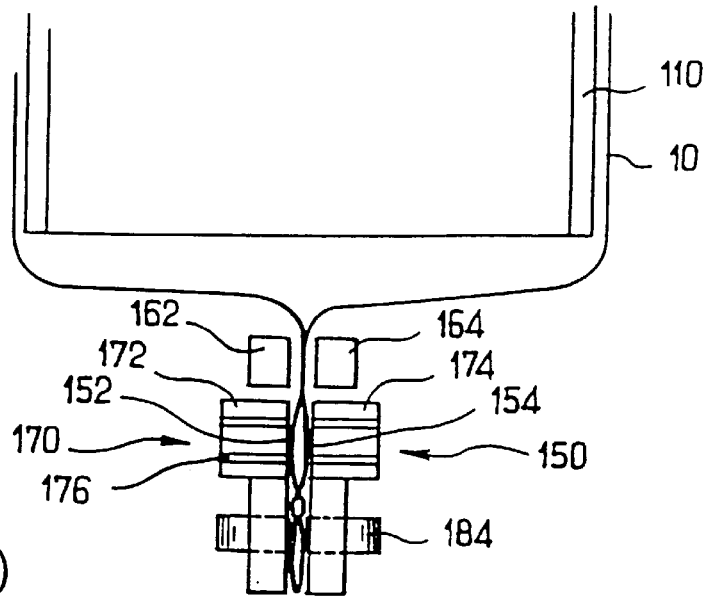
FIG. 10 illustrates diagrammatically, in cross section, the means illustrated in FIGS. 7, 8 and 9 at a subsequent step in the process.

The holding means 170 are then moved towards each other. The second welding means 150, integral with the holding means 170, therefore also clamp and come into action in order to weld the webs 55, 56 of the fastener assembly 50 to the walls 38, 40 (FIG. 10). At the same time, the link 60 is cut, separating the fastener assembly being welded from the remainder of the chain.

Figure 11:
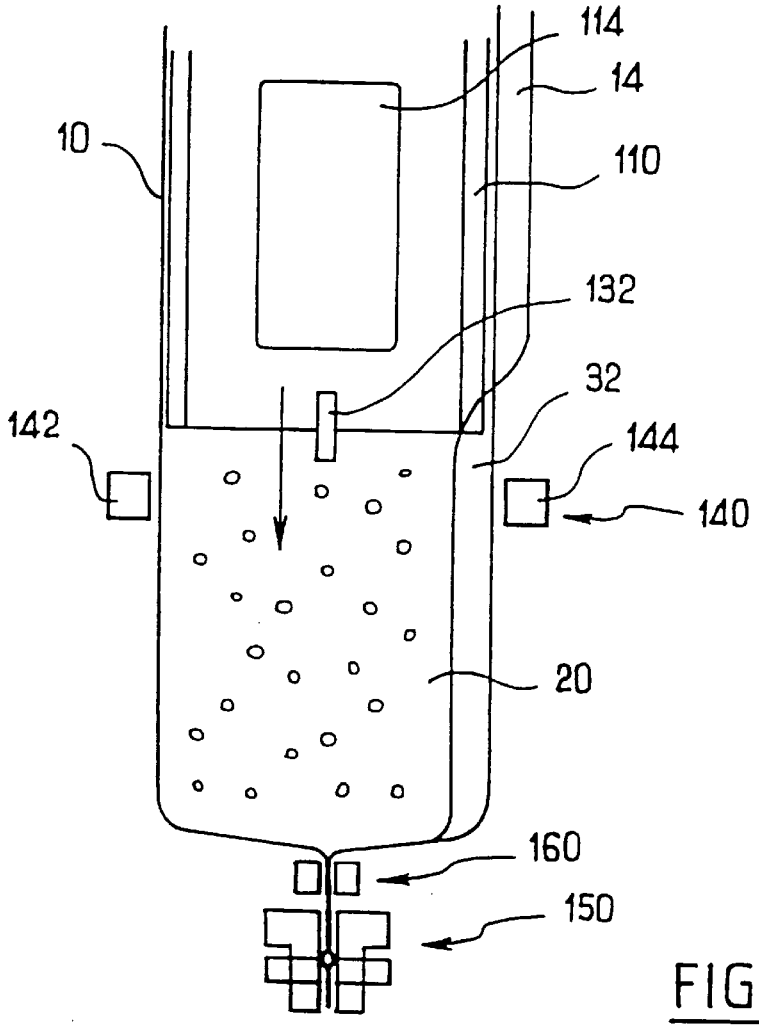
FIG. 11 is a diagrammatic view, in side elevation, of the FFS machine according to the invention at a subsequent step in the process with respect to that illustrated in FIG. 10.

Simultaneously with this welding operation, the combination of the clamping means 160 and the holding means 170 is moved longitudinally, over a distance approximately equivalent to the length of a bag 30, in the direction parallel to the movement of the tube 20. This operation is accompanied by the filling of the bag 30 (FIG. 11).

The walls 38, 40 of the bag 30 are then welded, using the first welding means 140 which then clamp onto the tube 20, transversely with respect to the direction of movement of the tube 20, at a distance approximately equal to the length of the bag 30 in this direction, upstream of the position for fixing the sealing strips 51, 52 (FIG. 12). The weld 34 transverse to the direction of movement of the tube 20 is formed by this operation (FIG. 13). Simultaneously, a step of cutting the tube 20, transversely with respect to the direction of movement of the tube 20, at a distance approximately equal to the length of the bag 30, upstream of the position for attaching the interlocking strips 51, 52, is carried out by cutting means 190 lying just above the first welding means 140. This allows the filled bag 30 to be separated from the rest of the tube 20 lying upstream (FIG. 12).

The clamping means 160, the holding means 170 and the first welding means 140 are then moved apart. The filled and completed bag 30 then drops onto a conveyor belt (FIG. 13).

Figure 14:
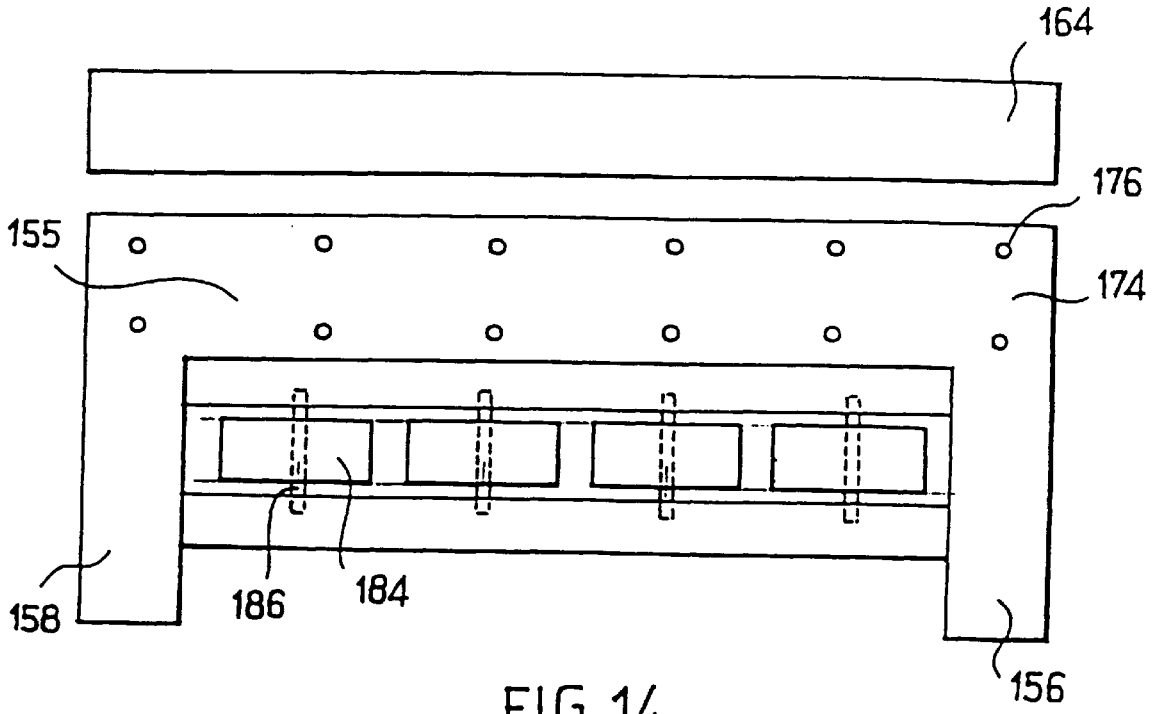
FIG. 14 illustrates diagrammatically, in side elevation, the holding and welding means of the FFS machine for implementing the process.
Figure 15:
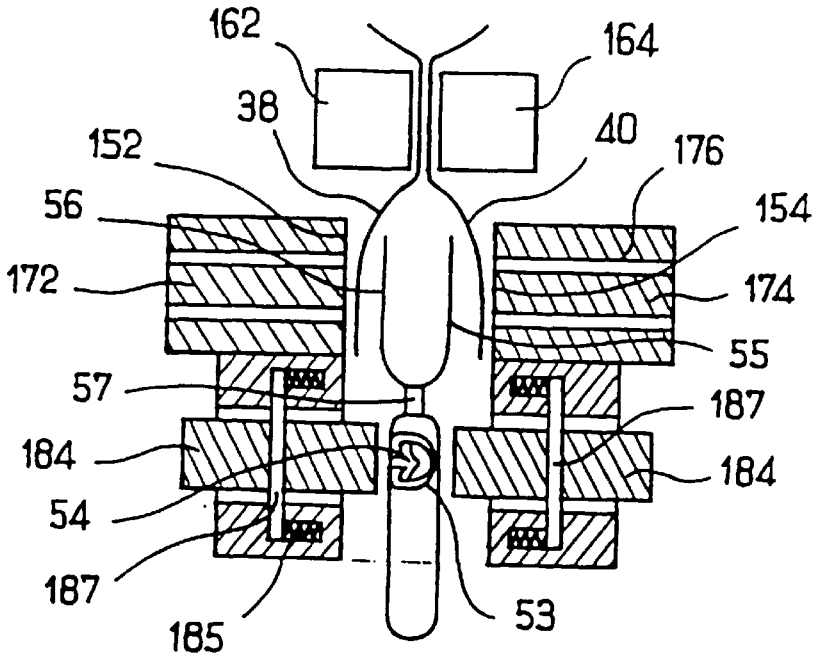
FIG. 15 illustrates diagrammatically, in cross section, the holding and welding means illustrated in FIG. 14.

An important component of the FFS machine for implementing the invention consists of the assembly formed by the second welding means 150, the clamping means 160 and the holding means 170. An example of such an assembly is illustrated in side elevation in FIG. 14 and in cross section in FIG. 15.

In this example, each bar 162, 164 of the clamping means 160 extends linearly, perpendicular to the direction of movement of the tube 20. The cross section of these bars 162, 164 is square although other shapes can be used. Their length is slightly greater than the dimension of a bag in the direction transverse to the movement of the tube 20.

Thus, the clamping means 160 may press the walls 38, 40 of the bag against each other over their entire length in the transverse direction. They lie upstream of the position for attaching the fastener assembly 50 to the walls 38, 40.

In one advantageous embodiment, the second welding means 150 and the holding means 170 are integral with each other. The holding means 172, 174 are mutually parallel and transverse with respect to the movement of the tube 20. They are each formed by a component 172, 174 in the form of an upside-down U. Each component 172, 174 has two legs 156, 158 which are parallel to the direction of movement of the tube 20. The distance between them is approximately equal to the dimension of a bag 30 perpendicular to this direction. These legs 156, 158 constitute a first part of the welding means 150. They weld the ends of the fastener assembly 50. The top ends of these legs 156, 158 are joined by a transverse bar 155. This bar 155 constitutes both the holding means 172, 174 and a second part of the welding means 150 which are used to weld the walls 38, 40 to the webs 55, 56.

The holding components 172, 174 are drilled with holes 176 emerging on those faces of these holding components 172, 174 which are opposite each other and intended to be in contact with the walls 38, 40. Each of the walls 38, 40 are held against a holding component 172, 174 by a vacuum through the distributed holes 176. The tube 20 is thus held by means of the holding components 172, 174 near the cut end, before they are moved apart (FIG. 14) in order to attach the two strips 51, 52 of which a fastener assembly 50 is composed to the inner face of the walls 38, 40 intended to form a bag 30.

A series of small wheels 184 is placed, just beneath the bar 155, along a line transverse with respect to the direction of movement of the tube 20. Each small wheel 184 rotates about an axle 187. The axles 187 of the small wheels 184 are parallel to the direction of movement of the tube 20. The small wheels 184 are arranged in pairs. The two small wheels 184 of each pair lie opposite each other on each side of the fastener assembly 50 in line with the profiles 53, 54. The axles 187 of the small wheels 184 of each pair ride in the grooves and are able to remain at a constant distance from each other by virtue of the spring means 185. Thus, when the holding means 170 and the second welding means 150 are clamped together, the small wheels 184 of each pair remain at the same distance from each other, bearing on the fastener assembly 50 at the profiles 53, 54.

The rotational motion of the small wheels 184 is synchronized with that of the grooved small rollers 182 of the guiding means 180.

Variants of the process according to the invention other than that described above are conceivable. For example, in another variation of the process, the reclosable strips 51, 52 of which the fastener assembly 50 is composed may be fixed to the outer face of the walls 38, 40 intended to form the bag 30. The FFS machine for implementing the process according to the invention is then modified in the manner illustrated in FIGS. 16 and 17.

Figure 16:
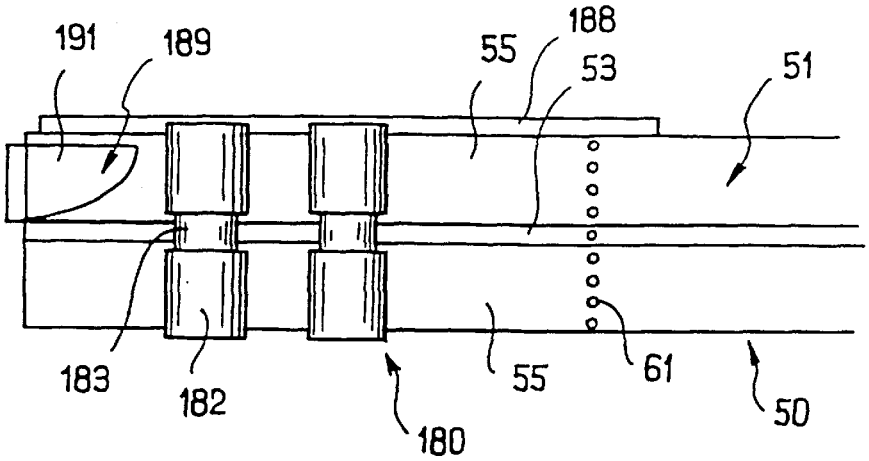
FIG. 16 illustrates, in side elevation, a variant of the guiding means of an FFS machine for implementing the process.
Figure 17:
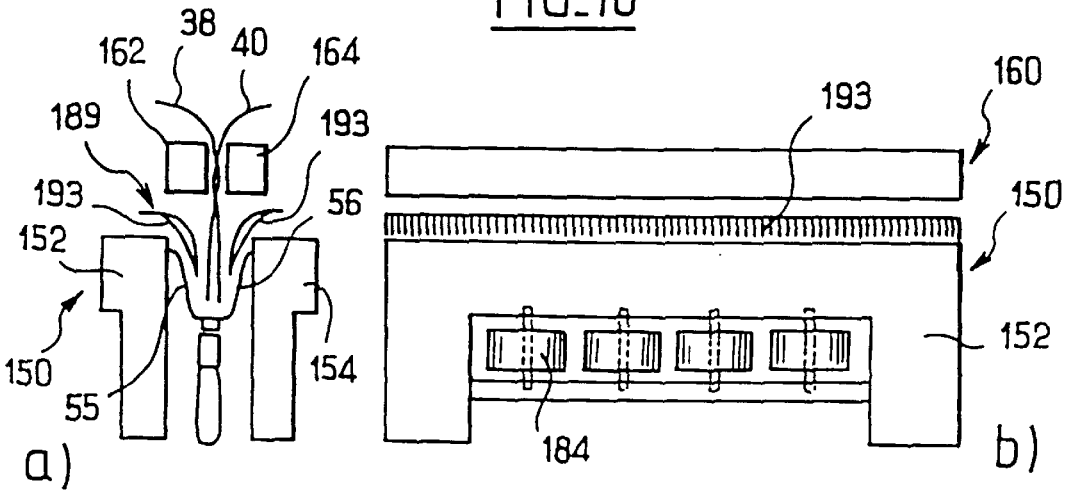
FIG. 17 illustrates diagrammatically in section, the welding means of a variant of the FFS machine for implementing the process shown in cross section (a) and side elevation (b)

Illustrated in FIG. 16 are two fastener assemblies 50 guided by guiding means 180. These two fastener assemblies 50 are linked to each other by a perforated region 61. This perforated region may consist of a series of aligned and uniformly spaced holes. The guiding means 180 consist of grooved small rollers 182, similar to the grooved small rollers 182 already described, and of a plate 188.

Separating means 189 separate the webs 55, 56 of the fastener assembly 50 apart from each other and guide them. These separating means 189 consist of a plough 191 and of two separating components 193. Each component 193 has the shape of a plate curved around an axis transverse with respect to the direction of movement of the tube 20, the axes of the components 193 being further apart at their far end than at heir near end. The plough 191 is inserted between the webs 55, 56 and the components 193 hold these webs 55, 56 away from each other over the entire length of the fastener assembly 50. The walls 38, 40 descend between the two components 193. That region of the walls 38, 40 which lies near their cut end is engaged between the webs 55, 56. The components 193 can then pivot about their longitudinal axis in order to clear the space lying between the webs 55, 56 and the walls 38, 40. Thereafter the second welding means 150 are clamped together and weld the webs 55, 56 to the walls 38, 40. The fastener webs may be treated with an adhesive material, if necessary, to facilitate attachment to the wall 38, 40.

According to another variation of the invention, the webs 55, 56 may only be separated just before their entry into the region of the welding means 150 so as to pass on each side of the combined walls 38, 40 when driven by the small wheels 184 or similar means before slipping onto the edge of these walls 38, 40, in order to be placed into position for welding.

In another variant of the FFS machine for implementing the process according to the invention, the small wheels 184 may be replaced by a guide 200. There are then several methods of positioning the fastener assembly 50 on the wall 38, 40 using the guide 20.

Figure 18:
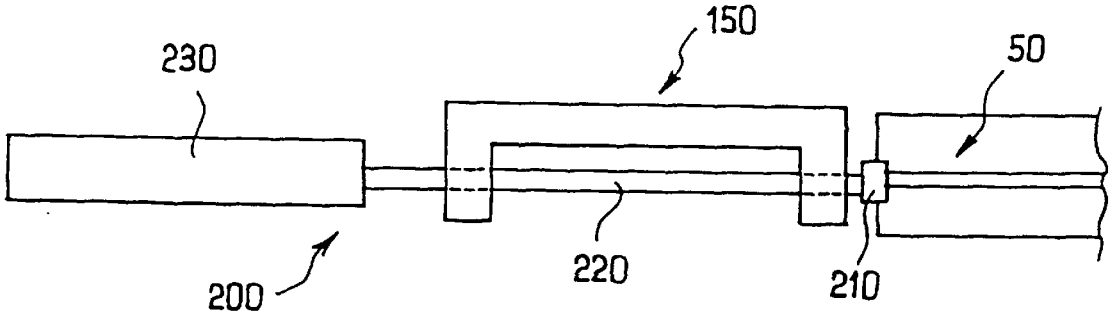
FIG. 18 is a view, in side elevation, of a variant of the means for guiding the fastener assembly for fastening the bags manufactured in accordance with the process.

In a first method, actuating means 230 are placed on the opposite side from the second welding means 150 with respect to the guiding means 180 (FIG. 18). The actuating means 230 move a rod 220 in a reciprocating motion. The rod 220, which is provided with a gripper 210, then grasps the fastener assembly 50. The gripper 210 may come into engagement with a slider 80 (not illustrated in FIG. 18) when the fastener assembly 50 is provided therewith. The fastener assembly 50 is then pulled between the second welding means 150 by retraction of the rod 220 into the actuating means 230. The gripper 210 and the rod 220 keep the fastener assembly 50 in position between the second welding means 152, 154 while these welding means 152, 154 clamp together in order to carry out the welding operation. The fastener assembly 50 is thus in precise alignment with respect to the walls 38, 40. The second welding means 152, 154 weld the webs 55, 56 to the walls 38, 40, the two slits 42, 44 to each other and the ends of the fastener assembly 50. These ends, in particular, are welded to the walls 38, 40 by the legs 156, 158. The bag 30 may optionally be provided with tear string.

In another method, the rod 220 supports the fastener assembly 50 which is actuated by means placed on the same side as the guiding means 180. The rod 220 is pushed between the second welding means 152, 154 and thus drives a fastener assembly 50.

Figure 19:
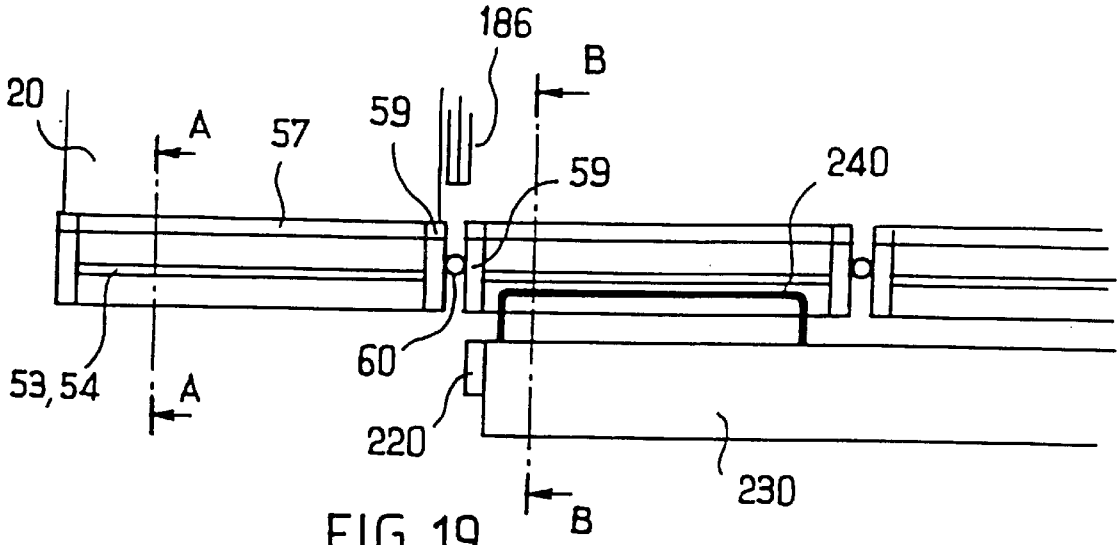
FIG. 19 is a view, in side elevation, of a variant of the means for guiding the fastener assembly for fastening the bags.
Figure 20:
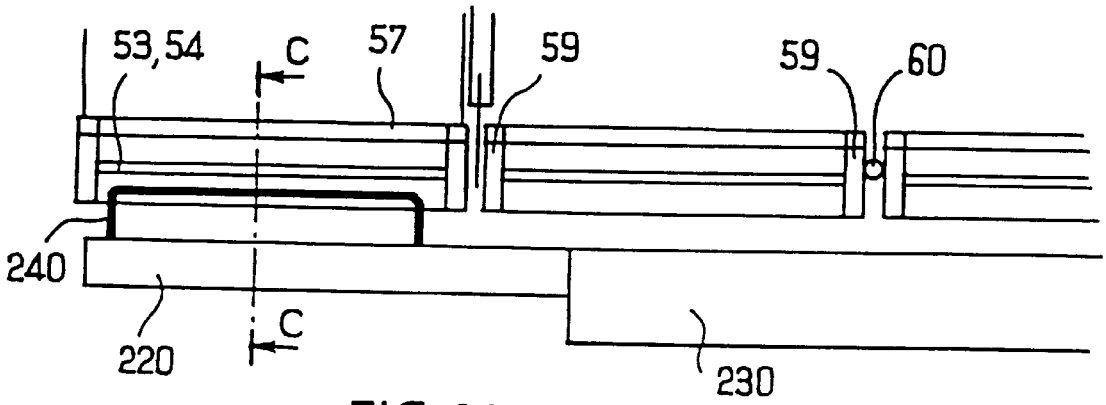
FIG. 20 is a side elevational view of the variant of the guiding means illustrated in FIG. 19 at a subsequent step in the process.
Figure 21:
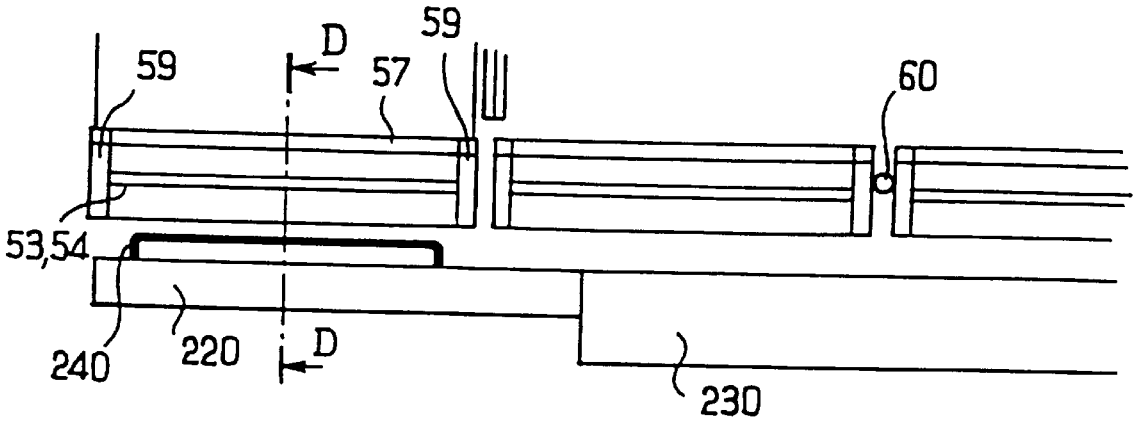
FIG. 21 is a side elevational view of the variant of the guiding means illustrated in FIGS. 19 and 20 at a subsequent step in the process.
Figure 22:
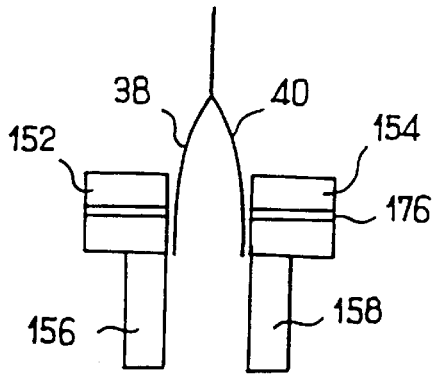
FIG. 22 is a diagrammatic section of the guiding means illustrated in FIGS. 19 and 26, respectively taken along section lines A—A and E—E.
Figure 23:
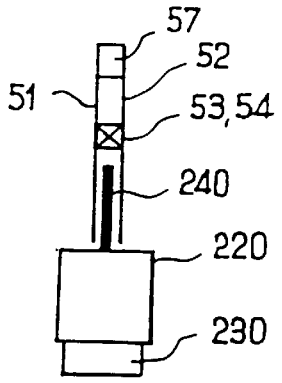
FIG. 23 is a diagrammatic section of the means illustrated in FIG. 19 taken along section line B—B.
Figure 24:
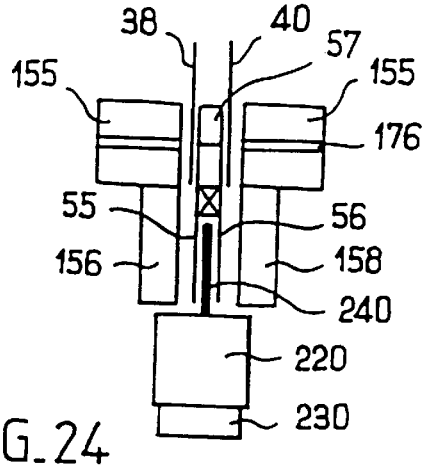
FIG. 24 is a diagrammatic section of the guiding means illustrated in FIG. 20 taken along section line C—C.
Figure 25:
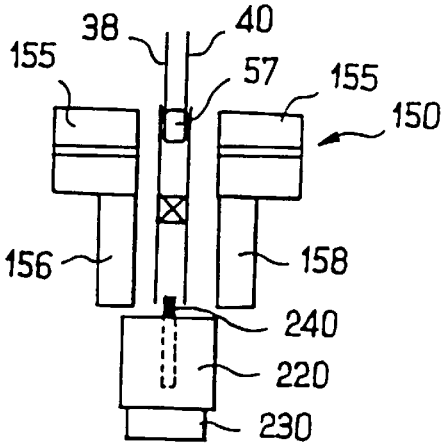
FIG. 25 is a diagrammatic section of the guiding means illustrated in FIG. 21 taken along section line D—D.

In this second method the rod 220 includes a support 240 for a fastener assembly 50. The rod is activated by actuation means 230 which are incorporated, for example, in the guiding means 180 (FIGS. 19, 22 and 23). The rod 220 lies beneath the fastener assemblies 50. The support 240 can move between two positions (FIGS. 19 and 21) in a vertical reciprocating motion. The rod 220 is positioned beneath the fastener assembly 50 lying at the entrance of the second welding means 150 and the holding means 170. The support 240 is lifted so as to be inserted between the strips 51, 52 of this fastener assembly 50 and support it in contact with the profiles 53, 54 which are in interlocked with one another. Laterally, the support 240 is inserted between the two end welds 59 of the fastener assembly 50. Thus, when the actuating means advance the rod 220 beneath the second welding means 150, the fastener assembly 50 is driven into position between welding means 150. (FIGS. 20 and 24). Once the fastener assembly is in position, it is welded to the walls 38, 40. Simultaneously to welding the webs 55, 56 to the walls 38, 40, the knife 186 cuts the link 60 with the next fastener assembly 50. While the fastener assembly is being welded to the bag wall the support 240 retracts into the rod 220 (FIGS. 21 and 25). The rod 220 then returns to its initial position, with the support 240 positioned beneath the next fastener assembly 50.

Figure 30:
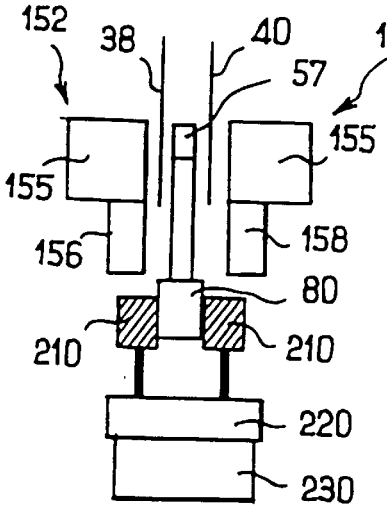
FIG. 30 is a diagrammatic section of the guiding means illustrated in FIG. 27 taken along section line G—G.
Figure 31:
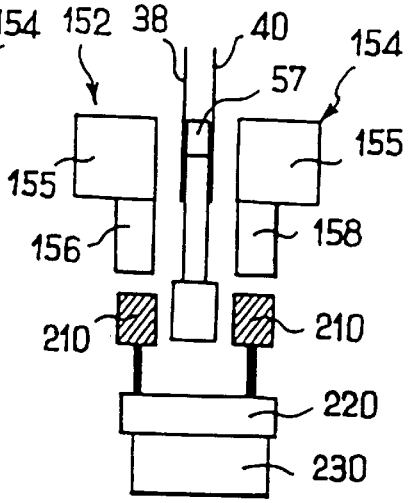
FIG. 31 is a diagrammatic section of the guiding means illustrated in FIG. 28 taken along section line H—H.
Figure 29:
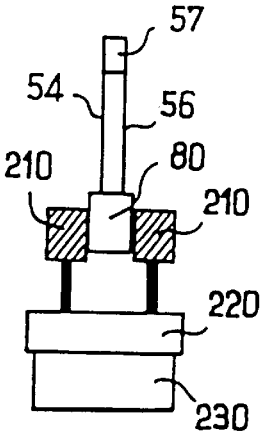
FIG. 29 is a diagrammatic section of the guiding means illustrated in FIG. 26 taken along section line F—F.
Figure 26:
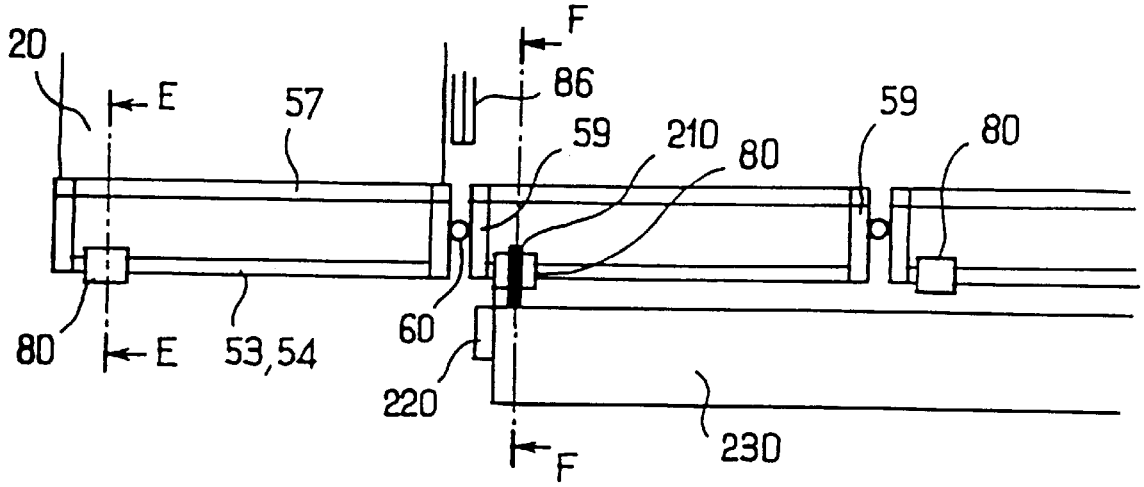
FIG. 26 is a view, in side elevation, of another variant of the means for guiding the fastener assembly for fastening the bags manufactured in accordance with the process.
Figure 27:
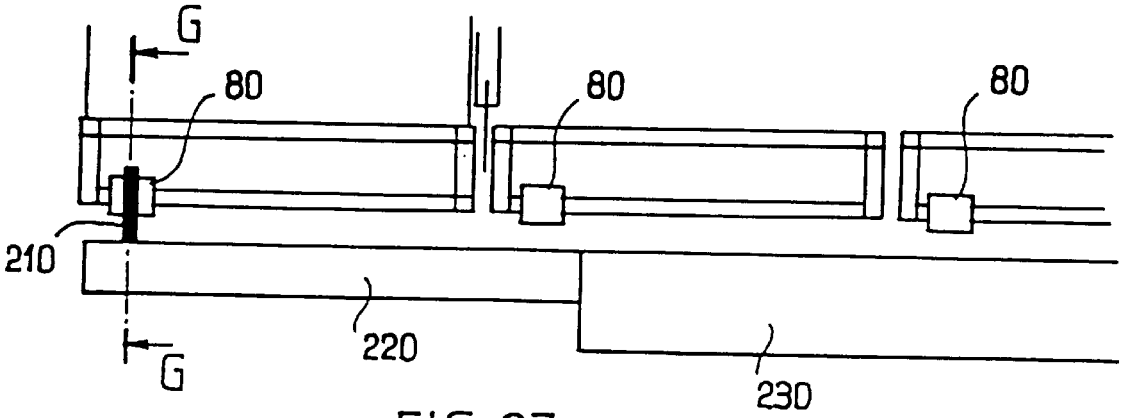
FIG. 27 is a view, in side elevation, of the variant of the guiding means illustrated in FIG. 26 at a subsequent step in the process.
Figure 28:
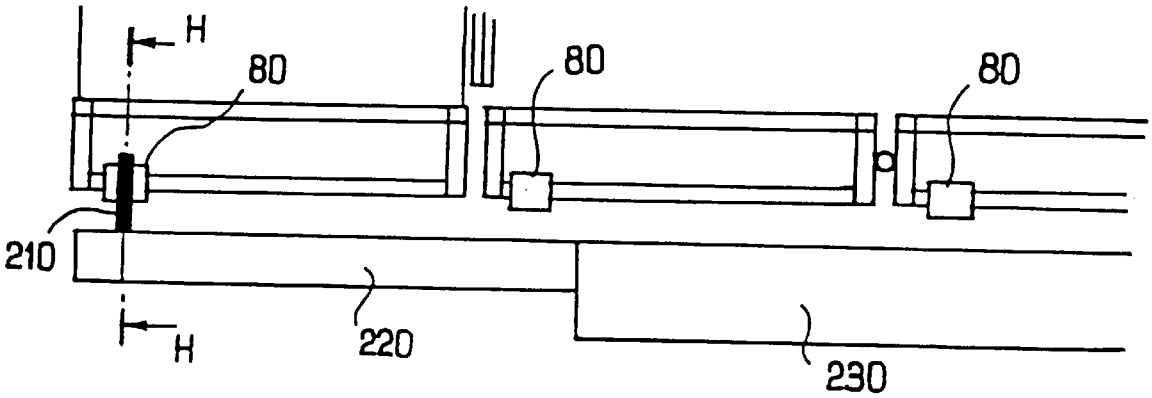
FIG. 28 is a view, in side elevation, of the guiding means illustrated in FIGS. 26 and 27 at a subsequent step in the process.

In a third method, the rod 220 comprises a gripper 210. This method can be used with a fastener assembly 50 having a slider, 80. In this case, a fastener assembly 50 is advanced just up to the entrance of the second welding means 150 and of the holding means 170 (FIG. 26). The slider 80 of this fastener assembly 50 butts up against that end weld 59 of this fastener assembly 50 which is closest to the second welding means 150 and the holding means 170. The gripper 210 grips onto the slider 80 (FIG. 29). The actuating means 230 advances the rod 220 which drives the fastener assembly 50 into position for welding to the bag walls. (FIGS. 27 and 30). Next, the fastener assembly 50 is welded to the walls 38, 40. The gripper 210 is then unclamped (FIGS. 28 and 31) and the rod 220 then resumes its initial position beneath the next fastener assembly 50.

Yet other variants of the process according to the invention may be provided.

The step of cutting the tube 20, transversely with respect to the direction of movement of the tube 20, at a distance approximately equal to the length of the bag 30 in the direction, upstream of the position for attaching the interlocking strips 51, 52 was described above. A step of perforating the tube 20, transversely with respect to the direction of movement of the tube 20, at a distance approximately equal to the length of the bag 30 in this direction, upstream of the position for attaching the reclosable strips 51, 52 is also possible. In this way, the bags 30 formed and filled by the process according to the invention remain attached to each other and are only separated subsequently, for example by the user.

However, there may also be the step of cutting or perforating the tube 20 near the closure strips 51, 52 transversely with respect to the direction of movement of the tube 20.

The step consisting in welding the walls 38, 40 of the bag 30, using first welding means 140, transversely with respect to the direction of movement of the tube 20 at a distance approximately equal to the length of the bag 30 in this direction, upstream of the position for attaching the reclosable strips 51, 52 has also been described above. It is also be envisaged that a step of welding the walls 38, 40 is carried out by the second welding means 150, near the position for attaching strips 51, 52, approximately transversely with respect to the direction of movement of the tube 20. However, it is also conceivable that this step of welding the walls 38, 40 to each other, near the sealing strips 51, 52, and the step of welding the walls 38, 40 transversely with respect to the direction of movement of the tube 20, downstream of the position of the previous welding, to be carried out by single welding means capable of performing a reciprocating motion between these two welding positions which are separated by approximately the length of a bag 30 in the direction of movement of the tube 20.

In another variation of the process according to the invention, the cutting or perforating step is carried out by cutting or perforating means 190 integral with the first welding means 140. However, a cutting or perforating step may also be carried out by cutting or perforating means 190 integral with the second welding means 150. If single welding means are used, the cutting or perforating means 190 may be integral with the latter.

It may also be envisaged for the step of attaching the reclosable strips 51, 52 to the walls 38, 40 to be carried out by attaching means independent of the second welding means 150 or of the single welding means 140.

A step of the process according to the invention consisting in pressing the walls 30, 40 intended to form the bag 30, one against each other, by virtue of the clamping means 160 has been described above. These clamping means 160 may be integral with the second welding means 150 or with the single welding means.

The process for manufacturing the bag according to the invention may be used for fixing sealing strips 51, 52 provided with webs 55, 56, on which webs a thermally reactivatable adhesive is deposited.

The process can also be used for fixing strips 51, 52 which are each provided, over their entire length, with webs 55, 56 which are capable of being sealed to each other on the inside of the bag by a peel seal or having a gasket film caught between the profiles or having a funnel arrangement.

I claim:

1. A process for manufacturing bags (30) on an automatic forming, filling and sealing (FFS) machine (100), which consists of the steps of:

advancing a tube (20) capable of forming walls (38, 40) of a bag (30) downstream of a vertical filling chute (110) of the FFS machine;

sequentially cutting the tube (20) into portions by a cut which is substantially transverse to the direction of movement of the tube (20);

attaching a fastener assembly (50) to a cut end of a part of the tube (20) that is below the chute (110).

2. The process in accordance with claim 1 further comprising the step of welding the walls (38, 40) of the bag (30) transversely with respect to the direction of movement of the tube (20), at a distance approximately equal to the length of the bag (30) in this direction, upstream of the position for fixing reclosable strips (51, 52).

3. The process in accordance with claim 1, wherein said fastener assembly comprises two reclosable strips (51, 52) and attaching the fastener assembly to an outer face of the tube.

4. The process in accordance with claim 1 wherein said fastener assembly comprises two reclosable strips (51, 52) and attaching the fastener assembly to an inner face of the tube.

5. The process in accordance with claim 4 comprising the further steps of holding the tube (20) near the cut end with two parallel holders 172, 174 mounted transverse with respect to the movement of the tube (20) and moving the holders apart to attach the reclosable strips (51, 52) to the inner face of the walls (38, 40).

6. The process in accordance with claim 5 wherein said tube is held by suction applied through holes distributed over the holding components.

7. The process in accordance with claim 1 comprising the further steps of:

pinching the bag wall forming portions of the tube together (38, 40), over their entire length in the direction transverse with respect to the direction of movement of the tube (20), upstream of the position for attaching reclosable strips (51, 52); and filling product into the bag (30), downstream of the pinching position through the filling chute (110) whereby said pinched together walls prevent filled product from interfering with said fastener attaching step.

8. The process in accordance with claim 1 comprising the further step of cutting two diametrically opposed slits (42, 44) in the wall of the tube at the same height along the tube (20)and inserting reclosable strips (51, 52) into the tube between the held-apart walls through the slits.

9. The process in accordance with claim 1 further comprising the step of cutting or perforating the tube (20), upstream of the position for attaching reclosable strips (51, 52), transversely with respect to the direction of movement of the tube (20), at a distance approximately equal to the length of a bag (30) in this direction.

10. The process in accordance with claim 1 further comprising the step of cutting or perforating the tube (20) near reclosable strips (51, 52) transversely with respect to the direction of movement of the tube (20).

11. The process in accordance with claim 1 further comprising the step of welding the walls (38, 40) together, near the position for attaching reclosable strips (51, 52) approximately transversely with respect to the direction of movement of the tube (20).

12. The process in accordance with claim 1 comprising the step of welding the walls (38, 40) to each other, near reclosable strips (51, 52), and welding the walls (38, 40) downstream of the previous welding position by single welding means capable of performing reciprocal motion between two welding positions separated by approximately the length of a bag (30) in the direction of movement of the tube (20).

13. The process in accordance with claim 1 further comprising the step of positioning the fastener assembly (50) between the walls (38, 40).

14. The process in accordance with claim 13 wherein said fastener is positioned by a rod (220) provided with a gripper (210) driven in a reciprocal motion.

15. A machine for the automatic forming, filling and sealing of bags (30) comprising means for advancing, downstream of a vertical filling chute (110), a tube (20) capable of forming walls (38, 40) of a bag (30)

cutting means (190) for cutting the tube (20) substantially transversely to its direction of movement, and means (150) for attaching a fastener assembly (50) to an end of the cut part of the tube (20) that is below the chute (110).

16. The machine as claimed in claim 15 further comprising means (170) for holding film (10) which extend transversely with respect to the direction of movement of the tube (20).

17. The machine in accordance with claim 16 further comprising holes (176) distributed over the holding means (172, 174) for supplying a vacuum against the film.

18. The machine in accordance with claim 16 wherein said holding means (170) are integral with welding means (150).

19. The machine in accordance with claim 16 further comprising means for positioning the fastener, said means including reciprocally movable gripper means adapted to grip said fastener and pull said fastener into a position for attachment to said bag walls.

20. The machine in accordance with claim 16 further comprising means for positioning the fastener between the walls, said means including a rod for supporting the fastener assembly, said rod being reciprocally movable between a raised position between the walls and a lowered position.

21. The machine in accordance with claim 20 wherein said positioning means further includes means for gripping a slider of said fastener assembly.

22. The machine in accordance with claim 15 further comprising single welding means capable of making a weld (36) which welds the walls (38, 40) together, near reclosable strips (51, 52), and a weld (34) which welds the walls (38, 40) together downstream of the previous weld by a distance substantially equal to the length of a bag to be formed.

23. The machine in accordance with claim 15 further comprising two diametrically opposed blades (130, 132) disposed and lying near the bottom part of the chute.

24. The machine in accordance with claim 15 further comprising first means (140) for welding the walls (38, 40) of the bag (30) upstream of the position for attaching reclosable strips (51, 52) to the walls (38, 40) to make a weld (34) that is substantially perpendicular to the direction of travel of the tube.

25. The machine in accordance with claim 24 further comprising cutting or perforating means integral with said first welding means.

26. The machine in accordance with claim 15 further comprising cutting or perforating means (190) near reclosable strips (51, 52) for cutting or perforating transversely with respect to the direction of movement of the tube (20).

27. The machine in accordance with claim 15 further comprising second welding means (150) for welding the walls (38, 40) together, near the position for attaching reclosable strips (51, 52) to the walls (38, 40) approximately transversely with respect to the direction of movement of the tube.

28. The machine in accordance with claim 27 further comprising a support (240) for the fastener assembly (50), said support (240) being reciprocable between two positions and being inserted, when in a raised position, between the strips (51, 52) and end welds (59), so as to drive the fastener assembly (50) beneath the second welding means (150).

29. The machine in accordance with claim 27 further comprising cutting or perforating means integral with said second welding means.

30. The machine in accordance with claim 15 further comprising pinching means (160) for pressing the walls (38, 40) of the bag against each other over their entire length in the direction transverse with respect to the direction of movement of the tube (20), said means being disposed upstream of the position for attaching the fastener assembly (50) to the walls (38, 40).

31. The machine in accordance with claim 15 further comprising means (180) provided with small rollers for guiding and advancing the fastener assembly (50).

32. The machine in accordance with claim 15 wherein said fastener assembly is provided as a part of a string of fastener assemblies and further comprising means for cutting said fastener assembly from said string.

33. The machine in accordance with claim 15 further comprising separating means (189) allowing webs (55, 56) of a fastener assembly (50) to be moved apart and guided.

* * * * *